US005690592A

United States Patent [19]

Heinrich

[11] Patent Number: 5,690,592

[45] Date of Patent: Nov. 25, 1997

[54] EXERCISING SYSTEM

[76] Inventor: Carl C. Heinrich, 5 Elaine St., Bozrah, Conn. 06334

[21] Appl. No.: 722,627

[22] Filed: Sep. 27, 1996

[51] Int. Cl.[6] ..... A63B 5/20; A63B 5/22

[52] U.S. Cl. ..... 482/82; 482/81

[58] Field of Search ..... 482/81, 82, 17, 482/907; 434/247; 24/115 H, 115 M, 66.9, 129 D

[56] References Cited

U.S. PATENT DOCUMENTS

| | | | |
|---|---|---|---|
| 169,625 | 11/1875 | Crandall . | |
| 2,832,116 | 4/1958 | Clevett | 24/115 H |
| 3,072,402 | 1/1963 | McCombs . | |
| 3,074,717 | 1/1963 | Lutz . | |
| 3,107,092 | 10/1963 | Morris et al. . | |
| 3,118,666 | 1/1964 | Fitch . | |
| 3,493,229 | 2/1970 | Ramsey . | |
| 3,610,616 | 10/1971 | Evans . | |
| 4,094,502 | 6/1978 | Cook . | |
| 4,135,713 | 1/1979 | Martin . | |
| 4,184,677 | 1/1980 | Murray . | |
| 5,062,628 | 11/1991 | Heyn et al. . | |
| 5,090,691 | 2/1992 | Pollack | 24/129 D |
| 5,234,393 | 8/1993 | Heinrich . | |
| 5,440,788 | 8/1995 | Boden | 24/129 D |
| 5,445,586 | 8/1995 | Yun | 482/82 |

FOREIGN PATENT DOCUMENTS

| | | | |
|---|---|---|---|
| 279894 | 10/1913 | Germany | 482/82 |

*Primary Examiner*—Joe Cheng
*Assistant Examiner*—Denise Pothier
*Attorney, Agent, or Firm*—Albert W. Hilburger

[57] ABSTRACT

An exercising system is provided to enable a user to obtain twice the exercise per unit time offered by a conventional jump rope. At the same time, the system of the invention provides the user with a construction as near to that of the conventional jump rope as possible. To this end, a pair of opposed mutually independent elongated tubular handles are mounted to a pair of hoop members over which the user jumps between their ends. The system is adjustable so as to accommodate a range of sizes of users and graduated indicia are provided on the hoop members to enable a user to achieve a desired size. Also, as with a conventional jump rope, the exercising system is width adjustable to the extent desired by the user.

11 Claims, 1 Drawing Sheet

EXERCISING SYSTEM

BACKGROUND OF THE INVENTION

1. Field of the Invention

This invention relates to an exercising system, and more particularly, to a modified jump rope device that allows the rope to rotate faster than normal and aid in exercising other parts of the body in addition to the legs.

2. Description of the Prior Art

Skipping rope has long been a favorite form of entertainment for children, boys and girls alike. Rope skipping is also used as a training exercise for many athletes, such as boxers, for exercising the legs and the cardiorespiratory/cardiovascular system. As is well known in the art, various types of jump rope exercises are presently being used, one being the typical jump rope that comprises an elongated section of rope having handles attached to each free end, so that the user can hold the rope and then rotate it about his body while jumping off the surface of the ground, allowing the turning rope to pass under the feet. The rope handles of this type of jump rope are generally actuated by the individual's wrist movement. More recently, attempts have been made to improve upon the exercise attained by the conventional type of jump rope by requiring the jumper to be subjected to multiple passes of the rope during the same time period previously required for one pass. These were often referred to as double jump rope or hoop constructions.

Typical of the prior art disclosing double jump rope or hoop constructions requiring the user to jump twice during a single revolution of the device are U.S. Pat. Nos. 169,625 to Crandall; 3,074,717 to Lutz; 3,118,666 to Fitch; 3,493,229 to Ramsey; 4,135,713 to Martin; and 4,184,677 to Murray. In each of these instances, the hoop or rope jumping device is crank operated. In some instances, the device is height adjustable, but in all instances disclosed in these patents, the device is restricted to a fixed width.

In some other instances, double hoop or rope constructions are provided using a pair of opposed hoop-type members which revolve about and are operated by a crossbar. Representative of this type of construction are U.S. Pat. Nos. 3,064,972 to Feinn; 3,072,402 to McCombs; and 5,062,628 to Heyn, et al. In most instances, these constructions are width limiting and, except for the McCombs patent, are height limiting as well.

In some instances, the devices are even motorized as disclosed in U.S. Pat. Nos. 3,107,092 to Morris, et al; and 3,610,616 to Evans. In the former instance, the ropes are even driven in opposite directions.

More recently, the inventor devised yet a further improvement in double jump rope devices, as disclosed in U.S. Pat. No. 5,234,393. In this instance, a universal connection is provided between handles held by the user and support members for a pair of hoop members over which the user jumps. The apparatus is adjustable so as to accommodate a range of sizes of users and graduated indicia are provided on the hoop members to enable a user to achieve a desired size.

It was with knowledge of the prior art as just discussed and the limitations existing in such prior art devices that the present invention has been conceived and is now reduced to practice.

SUMMARY OF THE INVENTION

As will be disclosed in detail below, an exercising system according to the invention enables a user to obtain twice the exercise per unit time offered by a conventional jump rope.

At the same time, the system of the invention provides the user with a construction as near to that of the conventional jump rope as possible. To this end, a pair of opposed mutually independent elongated tubular handles are mounted to a pair of hoop members over which the user jumps intermediate their ends. The system is adjustable so as to accommodate a range of sizes of users and graduated indicia are provided on the hoop members to enable a user to achieve a desired size. Also, as with a conventional jump rope, the exercising system is width adjustable to the extent desired by the user.

Although the exercising apparatus of his U.S. Pat. No. 5,234,393 represented a distinct improvement over the prior art then known, the inventor has come to realize that elimination of the universal joint provided in that construction would be a further benefit to the user. By eliminating the universal joint and providing the construction of the present invention, the user is compelled to use wrist action of the type required during conventional rope jumping. This action results in strengthening of the wrists as well as improving eye-foot coordination by the user.

A principal object of this invention is to provide an improved, yet simply constructed, rope jumping device.

More specifically, it is an object of the present invention to provide an improved revolving jump rope device, which provides for multiple skipping per revolution of the device which is balanced and stabilized in operation and may be readily manipulated and safely operated by and completely under the control of the hands of the user.

Another object of the invention is to provide an improved rope jumping system which is readily operable for turning and changing skipping directions and is readily usable by users of various sizes, both height-wise and breadth-wise.

A further object of the invention is to provide an exercise system which is simple and rugged in construction, is inexpensive to manufacture and easy to assemble, utilizes commonly available materials in its construction, has utility in gymnasiums and the like for body building and exercising programs, and is pleasurable to use by children and also by adults.

Yet another object of the invention is to provide a construction which enables it to be readily telescoped to a minimal size for storage or for travel and, thereafter, enables it to be readily extended for use.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts throughout the disclosure.

DETAILED DESCRIPTION OF THE PREFERRED EMBODIMENT

Figure 1:
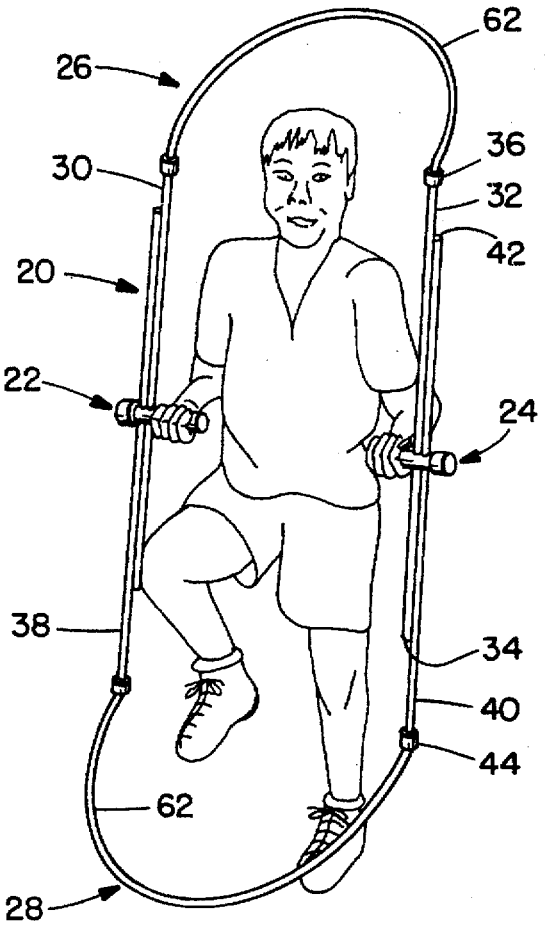
FIG. 1 is a perspective view of a person using an exercising system of the double jump type embodying the present invention.

Turn now to the drawings and, initially, to FIG. 1 which generally illustrates the use of an exercising system 20 which embodies the present invention. As depicted in FIG. 1, first and second opposed mutually independent elongated tubular handles 22, 24 are positioned on opposite sides of the user and held by the user in a manner to be described. A first hoop construction 26 includes a pair of parallel, spaced apart leg members 30, 32 which extend, respectively, between inner and outer terminal ends 34, 36.

In a similar fashion, the second hoop construction includes third and fourth parallel, spaced apart, leg members 38, 40 which extend, respectively, between inner and outer terminal ends 42, 44, respectively. The leg members may be composed of wood dowelling, rods of fiberglass or of other suitable moderately flexible lightweight material which can be readily fabricated into elongated, small diameter, members generally as indicated.

Suitable lengths of flexible elongated cord or rope 62 are attached to the outer terminal ends 36 of the leg members 30, 32 and likewise to the outer terminal ends 44 of the leg members 38, 40. It is preferred that the cord 62 does not extend in a taut manner between its respective leg members. Rather, it is desirable for the cord 62 to form a loop generally simulating a conventional jump rope over which the user is supposed to jump.

The pair of handles 22, 24 (see FIG. 2) which are intended to be gripped by the user are mounted to the leg members 30, 32, 38, 40 intermediate the first and second hoop constructions 26, 28. By reason of the fact that the handles 22, 24 associated with the hoop constructions 26, 28 are independent of one another, the exercising system 20 of the invention has a "feel" as close to that of a conventional jump rope as possible while incorporating many features not found in conventional jump rope simulating devices.

Figure 3:
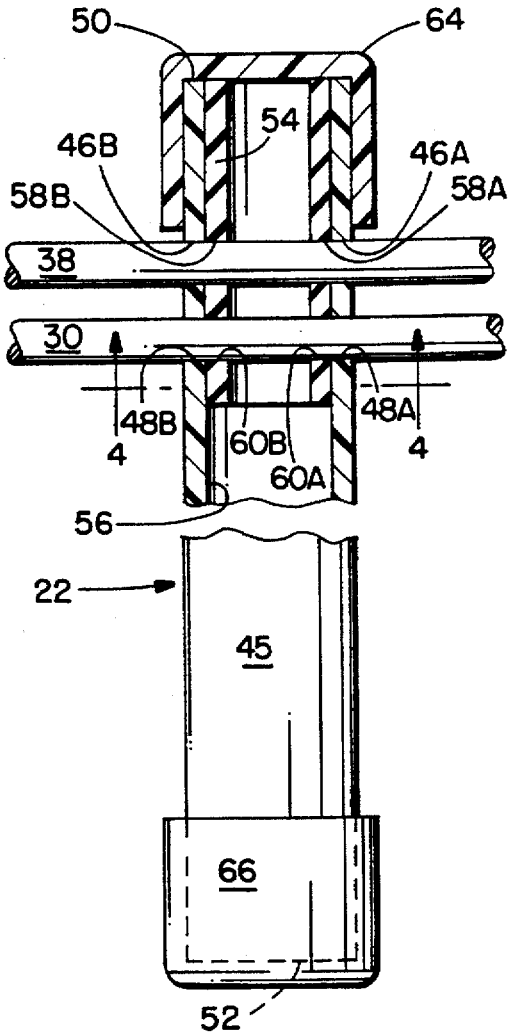
FIG. 3 is a detail side elevational view of parts illustrated in FIG. 2, certain parts being broken away and shown in section.
Figure 2:
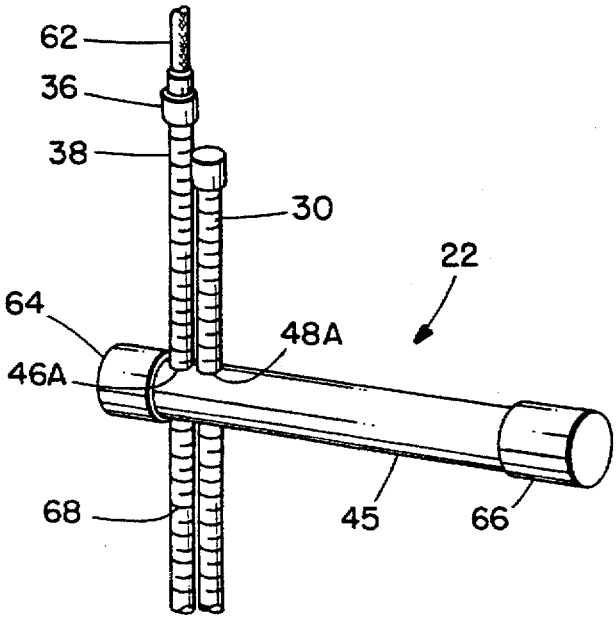
FIG. 2 is a detail perspective view illustrating part of the system illustrated in FIG. 1.

The system 20, and especially the handles 22, 24 will now be described with particular reference to FIGS. 2, 3, and 4. It will be appreciated that the two opposed handles are identical such that a description of handle 22 is also appropriate for handle 24. Thus, handle 22 includes a tubular member 45 which has a first pair 46A, 46B and second pair 48A, 48B of aligned diametrically opposed transversely extending mounting bores therethrough. The first pair of mounting bores 46A, 46B are longitudinally spaced, that is, spaced between opposed ends 50, 52 of the tubular member 45, from the second pair of mounting bores 48A, 48B, respectively.

The leg members 30, 32 extend through the first pairs of bores 48A, 48B in the handles 22, 24, respectively; similarly, the leg members 38, 40 extend through the second pairs of bores 46A, 46B in the handles, respectively, but oppositely. The bores and the leg members are mutually sized such that the leg members slide substantially freely through the bores.

As will now be described, gripper devices are provided on the handles 22, 24 for adjustably mounting the leg members to the handles. To this end, a friction member in the form of a sleeve 54 is provided within the inner channel 56 of each of the handles 22, 24 adjacent the mounting bores 46A, 46B, 48A, 48B for frictionally engaging the leg members 38, 30, and 40, 32 and preventing unintended movement of the leg members relative to their associated handles. The friction member or sleeve 54 is of rubber-like material coaxially received in the inner channel 56 of each of the handles and is formed with apertures 58A, 58B therethrough aligned with the mounting bores 46A, 46B and with apertures 60A, 60B therethrough aligned with the mounting bores 48A, 48B. The apertures 58A, 58B, 60A, 60B are sized for fitting engagement with their associated leg members.

Figure 4:
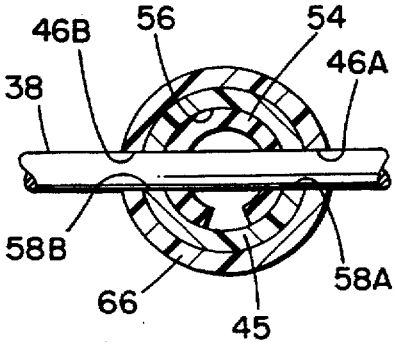
FIG. 4 is a detail cross sectional view taken generally along line 4—4 in FIG. 3.

The sleeve 54 may be longitudinally slit as illustrated so as to appear C-shaped in cross section (see FIG. 4). In this instance, by reason of its resilience, it would tend to spread to a condition of greater diameter so as to be biased into engagement with the inner channel 56. It might also be desirable to bond the sleeve 54 to the inner channel 56 using a suitable bonding agent. Also, the sleeve may be fully tubular, that is, not longitudinally slit.

It may be desirable for the leg members 30, 32, 38, 40 to include markings at a plurality of regularly spaced locations for indicating their positions in relation to the handles 22, 24. With such a provision, the user is able to return the system to a previous, known, size or to a new size which itself can be retrieved at a future time.

In order to complete the description of the exercising system of the invention, note that cap members 64, 66 may be suitably mounted on each of the opposed ends 50, 52 of the handles 22, 24. The cap members improve the appearance of the handles, keep the interior regions of the handles clean, and eliminate any sharp edges which might otherwise harm the person or clothing of the user.

When the exercising system 20 is not in use, the leg members 30, 32, 38, 40 may be slid longitudinally relative to the handles 22, 24 so that the terminal ends 36 and 42 are proximate to one another and so that the terminal ends 34 and 44 are proximate to one another. In this manner, the exercising system 20 is reduced to its smallest possible size for ease of storage and transportability. When it is again desired to use it, the leg members can readily to returned to those positions desired by the user with the aid of the markings 68.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. An exercising system comprising:

hoop means including first and second opposed leg members and a first elongated integral transverse member attached at opposite ends to said first and second leg members and over which a user can jump;

first and second opposed mutually independent elongated tubular handles, each having an inner channel;

means inflexibly mounting said first and second handles to said first and second leg members, respectively, each of said first and second handles having a first and second pair of aligned diametrically opposed mounting bores therethrough, the first pair of mounting bores being longitudinally spaced from the second pair of mounting bores, said first leg members extending through the first pairs of bores in said first and second handles, respectively, said second leg members extending through the second pairs of bores in said first and second handles, respectively; and gripper means on said first and second handles for frictionally engaging said first and second leg members, said first and second leg members being selectively adjustably movable longitudinally of said handles, wherein said gripper means includes a friction member within each of said inner channels of said first and second handles adjacent the first and second pairs of mounting bores for frictionally engaging said first and second leg members and preventing unintended movement of said leg members relative to said handles.

2. An exercising system as set forth in claim 1 wherein said friction member includes a sleeve of rubber material coaxially received in the inner channel of each of said first and second tubular handles, said sleeve having apertures therethrough aligned with the first and second pairs of mounting bores, the apertures being sized for fitting engagement with said first and second leg members.

3. The exercising system as set forth in claim 1 wherein said transverse member includes a flexible elongated cord extending between and attached to said first and second leg members, respectively.

4. An exercising system as set forth in claim 1 wherein said first and second leg members include markings thereon at a plurality of regularly spaced locations for indicating the position thereof in relation to said first and second handles.

5. The exercising system as set forth in claim 1 wherein said hoop means includes:

a first hoop member including said first and second opposed leg members, each of said first and second leg members having inboard and outboard ends; and said first elongated integral transverse member including a flexible cord connected at its opposite ends, respectively, to said outboard ends of said first and second leg members; and a second hoop member including third and fourth opposed leg members generally parallel to said first and second opposed leg members, each of said third and fourth leg members having inboard and outboard ends; and a second elongated integral transverse member including a flexible cord connected at its opposite ends, respectively, to said outboard ends of said third and fourth leg members.

6. The exercising system as set forth in claim 1 including:

cap members mounted on first and second open ends of said first and second handles, respectively.

7. An exercising system comprising:

first hoop means including first and second parallel spaced apart leg members extending between inner and outer terminal ends;

second hoop means including third and fourth parallel spaced apart leg members extending between inner and outer terminal ends;

a first elongated tubular handles having an inner channel and a first pair of aligned diametrically opposed mounting bores for engageably receiving said first leg member of said first hoop means proximate said inner terminal end thereof and a second pair of aligned diametrically opposed mounting bores for engageably receiving said third leg member of said second hoop means proximate said inner terminal end thereof such that said first tubular handle is inflexibly mounted to said first and third leg members of said first and second hoop means, respectively;

a second elongated tubular handle having an inner channel and a second pair of aligned diametrically opposed mounting bores for engageably receiving said second leg member of said first hoop means proximate said inner tubular end thereof and a second pair of aligned diametrically opposed mounting bores for engageably receiving said fourth leg member of said second hoop means proximate said inner terminal end thereof such that said first tubular handle is inflexibly mounted to said second and fourth leg members of said first and second hoop means, respectively; and gripper means on said first and second handles for adjustably mounting said first and second leg members thereto, wherein said gripper means includes a friction member within each of said inner channels of said first and second handles adjacent the first and second pairs of mounting bores for frictionally engaging said first and second leg members and preventing unintended movement of said leg members relative to said handles.

8. The exercising system as set forth in claim 7 wherein said first hoop means includes:

a flexible elongated cord extending between and attached to said outer ends of said first and second leg members; and wherein said second hoop means includes:

a flexible elongated cord extending between and attached to said outer ends of said third and fourth leg members.

9. The exercising system as set forth in claim 7 wherein said friction member includes a sleeve of rubber material having apertures therethrough aligned with the first and second pairs of mounting bores, the apertures being sized for fitting engagement with said first and second leg members.

10. The exercising system as set forth in claim 9 wherein said first and second leg members of said first and second hoop members include markings thereon at a plurality of regularly spaced locations for indicating the position thereof in relation to said first and second support means.

11. The exercising system as set forth in claim 7 including:

cap members mounted on first and second open ends of said first and second handles, respectively.

* * * * *